US005275282A

United States Patent [19]

Ross et al.

[11] Patent Number: 5,275,282

[45] Date of Patent: Jan. 4, 1994

[54] DOCUMENT HOLDER

[76] Inventors: Chet Ross, 1113 Adelaide Dr., Tucson, Ariz. 85719; Michael Green, 6707 N. 60th St., Paradise Valley, Ariz. 85253

[21] Appl. No.: 933,398

[22] Filed: Aug. 19, 1992

[51] Int. Cl.[5] ..... B65D 85/67; G09F 3/16

[52] U.S. Cl. ..... 206/389; 40/309; 40/666

[58] Field of Search ..... 40/306, 309, 323, 660, 40/649, 650, 666, 658, 316; 294/148, 137; 206/446, 308, 389, 424, 412

[56] References Cited

U.S. PATENT DOCUMENTS

| | | | |
|---|---|---|---|
| 614,197 | 11/1898 | Boone | 40/666 |
| 3,713,576 | 1/1973 | Goebel . | |
| 3,856,199 | 12/1974 | Gartz . | |
| 4,268,986 | 5/1981 | Piana | 40/661 |
| 4,467,917 | 8/1984 | Hayashi | 206/412 |
| 4,505,424 | 3/1985 | Chappars | 206/412 X |
| 4,519,497 | 5/1985 | Brinkers | 206/389 |
| 4,796,936 | 1/1989 | Sherin | 294/148 |
| 4,876,809 | 10/1989 | Johnson | 40/309 |
| 4,899,474 | 2/1990 | Piana et al. | 40/658 |

FOREIGN PATENT DOCUMENTS

| | | | |
|---|---|---|---|
| 674239 | 11/1963 | Canada | 40/316 |
| 722128 | 1/1955 | United Kingdom | 40/316 |

*Primary Examiner*—William I. Price

*Attorney, Agent, or Firm*—Ogram & Teplitz

[57] ABSTRACT

A document holder comprising a slotted open-ended sleeve dimensioned to permit facile insertion and removal of a medial length of rolled document thereinto and therefrom through its slot, and to retain the document in a rolled configuration of predetermined diameter convenient for storage. The document holder may also be provided with a substantially flat exterior labeling surface to facilitate labeling of the document in rolled condition for ready filing and retrieval from storage.

16 Claims, 1 Drawing Sheet

DOCUMENT HOLDER

BACKGROUND OF THE INVENTION

This invention relates to a holding device designed to retain documents in a rolled configuration, and more particularly, to a drawing or document holder which facilitates the storage and labeling of blueprints and other large drawings.

Many types of normally flat documents, such as blueprints, drawings, paintings, maps, posters, certificates, photographs and the like, are typically maintained in rolled configuration for storage purposes. Particularly where the documents are of relatively large size, such as blueprints, and may require storage together with numerous other sets of such documents, the various means conventionally employed for retaining the documents in rolled condition all have certain drawbacks. Simple rubber bands can often be cumbersome to apply and remove, tend to cause tears in the edges of the document, and are not conducive for facilitating either uniformity of roll diameter or labeling of the documents in rolled condition. While fully encasing storage tubes may overcome most of these problems, the added bulkiness and cost are generally not justified. Furthermore, removal of documents from the confines of such tubes is often impeded by the document becoming unwound within the tube.

SUMMARY OF THE INVENTION

It is, accordingly, a primary object of the present invention to provide a relatively inexpensive and compact document holder which is effective for retaining documents in a rolled configuration of predetermined diameter convenient for storage, and which permits facile insertion and removal of rolled documents.

Another object of the invention is to provide a document holder in accordance with the preceding object, which facilitates labeling of the documents in rolled condition for ready filing and retrieval from storage.

The above and other objects are achieved in accordance with the present invention by providing a document holder in the form of an open-ended sleeve of relatively rigid material and having a wall portion defining a hollow interior portion. The dimensions of the interior portion of the sleeve correspond to a diameter which, when assumed by a rolled document, is predetermined to be convenient for storage. The wall portion of the sleeve is provided with a continuous longitudinal slot extending therethrough along the entire length of the sleeve and opening into the interior portion of the sleeve. The slot is of sufficient width so as to permit passage of a medial length of rolled document therethrough into and out of the interior portion of the sleeve when the document is wound to a tightness corresponding to diameter sufficiently less than the predetermined diameter. The slot is also sufficiently narrow so as to retain the medial length of rolled document within the interior portion of the sleeve when the rolled document is allowed to untighten to the predetermined diameter. In a preferred embodiment of the invention, the exterior of the sleeve is provided with a substantially flat labeling surface to facilitate labeling of the document in rolled condition for ready filing and retrieval from storage.

The invention, together with its embodiments, will be more fully described by the following detailed description considered in conjunction with the accompanying drawings.

DETAILED DESCRIPTION OF THE PREFERRED EMBODIMENTS OF THE SUBJECT INVENTION

Figure 1:
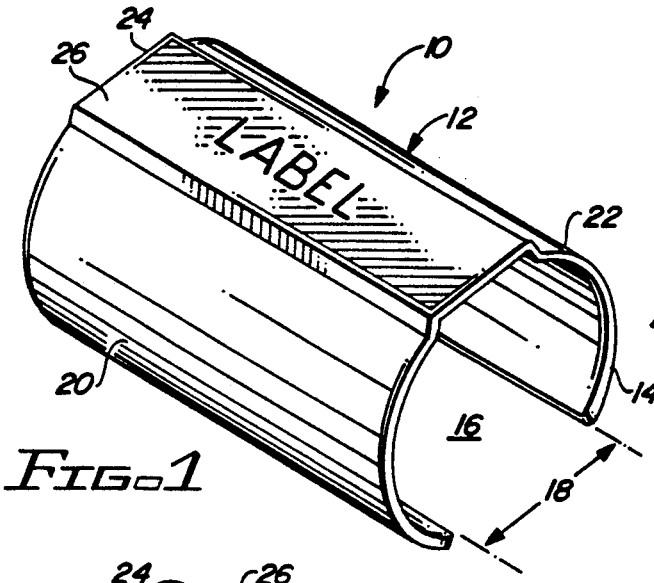
FIG. 1 is a perspective view of a document holder in accordance with the present invention.
Figure 2:
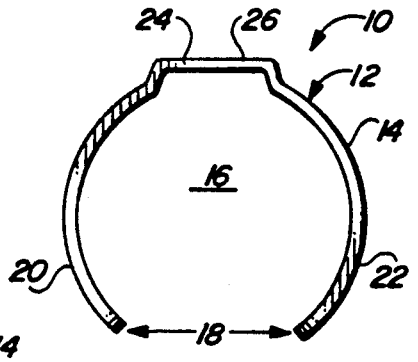
FIG. 2 is a front elevational view of the document holder shown in FIG. 1.

Referring now to FIGS. 1 and 2 of the drawings, a document holder 10 in accordance with the present invention, is shown in the form of an open-ended sleeve 12 fabricated of relatively rigid material, such as plastic, metal, rubber or stiff paperboard. The sleeve 12 has a wall portion 14 defining a hollow interior portion 16. The wall portion 14 as illustrated has a generally cylindrical shape, although other more polygonal shapes may, if desired, be substituted. A continuous longitudinal slot 18 extends through the wall portion 14 along the entire length of the sleeve 12 and opens into the hollow interior portion 16.

The hollow interior portion 16 of the sleeve 12 is designed to receive a medial length of rolled document through the slot 18 and accommodate the document in a rolled configuration of predetermined diameter convenient for storage. To this end, the dimensions of the interior portion 16 correspond to such predetermined diameter, which might vary in accordance with the type of document being stored and the preference of the user, but preferably would be within the range of from 1½ to 4 inches.

The slot 18 is of sufficient width so as to permit passage of a medial length of rolled document therethrough into and out of the interior portion 16 of the sleeve 12 when the document is wound to a tightness corresponding to a diameter sufficiently less than the predetermined diameter. At the same time, the slot 18 is also sufficiently narrow so as to retain the medial length of rolled document within the interior portion 16 of the sleeve 12 when the rolled document is allowed to untighten to the predetermined diameter. A slot width which would facilitate both of these functions would typically be one providing a radial aperture through the wall portion 14 of the sleeve 12 within the range of from about 45 to less than 90 degrees.

Figure 3:
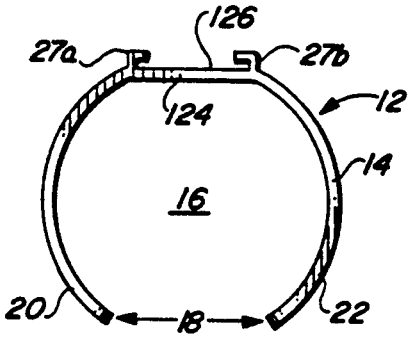

As shown in FIGS. 1 and 2, the wall portion 14 of the sleeve 12 is formed with two generally cylindrical sections 20 and 22 joined together by a flattened intermediate section 24, which is positioned diametrically opposite from the slot 18, and which projects radially outwardly beyond the cylinder circumscribed by its adjoining cylindrical sections 20 and 22. The radially outwardly projecting flattened intermediate section 24 serves to prevent the document holder from rolling off an angled work surface, and also provides the exterior of the sleeve 12 with a substantially flat protruding labeling surface 26 extending longitudinally along the entire length of the sleeve 12 to facilitate prominent labeling of the document in rolled condition for ready filing and retrieval from storage. The labeling surface 26 is adapted for direct writing thereon with a marking pen, or having an adhesive label applied thereon.

Where prominence of the labeling surface is of less concern, and a more compact design is preferred, the alternative embodiment shown in FIG. 3 is employed. In the FIG. 3 embodiment, the radially outwardly projecting flattened intermediate section 24 of the previously described embodiment, is replaced with a flattened intermediate section 124 which truncates the cylinder circumscribed by its adjoining cylindrical sections 20 and 22 to provide the exterior of the sleeve 12 with a substantially flat labeling surface 126 within the boundaries of such cylinder. The labeling surface 126 is provided with a pair of parallel complimentary bracketing members 27*a* and 27*b* extending longitudinally along the length of the labeling surface 126 and projecting radially outwardly therefrom to provide a means for removably inserting and retaining a label therebetween on the labeling surface 126. It will be understood that the bracketing members 27*a* and 27*b* may optionally likewise be employed in conjunction with the labeling surface 26 of the embodiments illustrated in FIGS. 1, 2 and 4.

Figure 4:
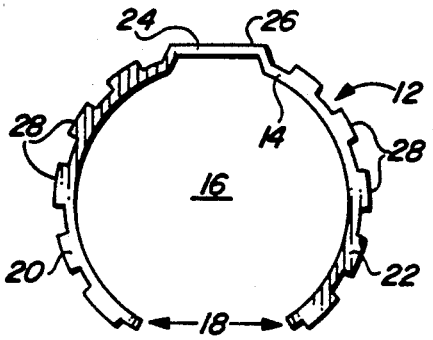
FIGS. 3 and 4 are front elevational views of alternative embodiments of the document holder.

In the alternative embodiment shown in FIG. 4, the wall portion 14 of the sleeve 12 is formed with a plurality of grip-enhancing ribs 28 spaced on the outer surface of its cylindrical sections 20 and 22. The ribs 28 preferably extend longitudinally along the entire length of the sleeve 12, generally parallel with the labeling surface 26.

Conventional plastic extrusion molding techniques well known in the art, can be used to easily and economically fabricate document holders in accordance with the present invention, which are durable, reusable and may be color-coded for use with documents of different types. The document holders may be made in varying lengths and diameters, depending upon the type of document being stored and the preference of the user. For example, a document holder in accordance with the present invention having a length of 3 inches and a diameter of 1¾ inches, has been found to be suitable for labeling and storage of blueprints and other similarly large drawings.

Figure 5:
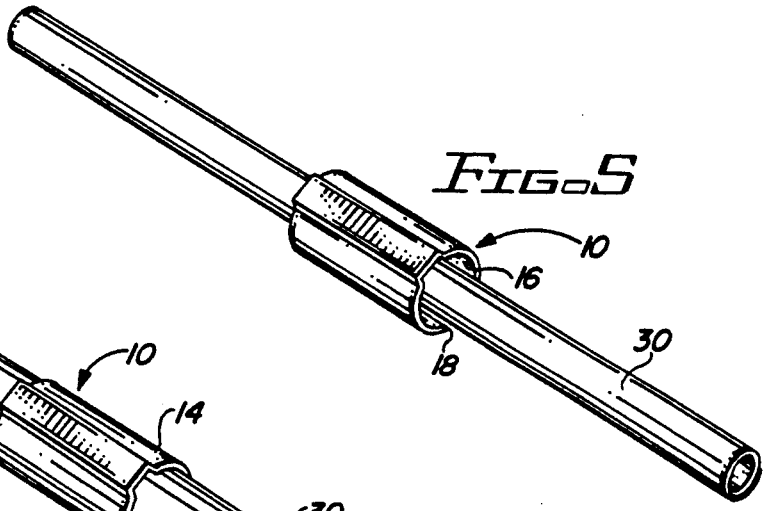
FIG. 5 is a perspective view illustrating the insertion or removal of a rolled document into or from the document holder shown in FIG. 1.
Figure 6:
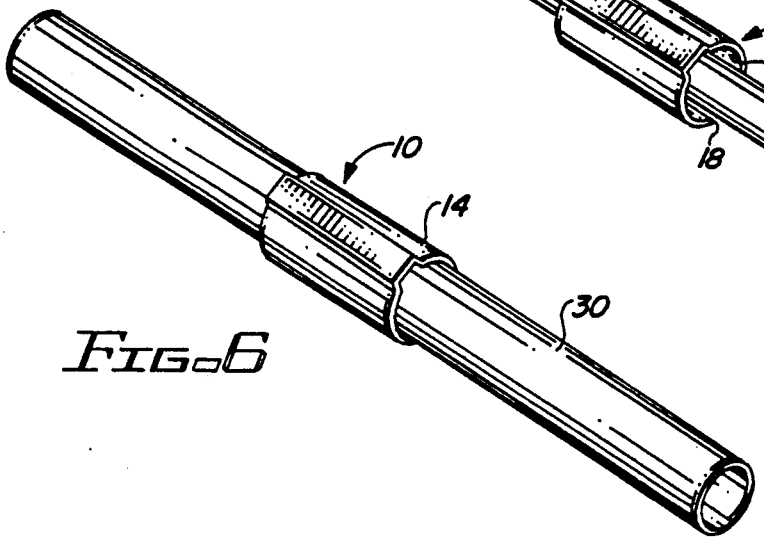
FIG. 6 is a perspective view similar to FIG. 5 showing the rolled document in its storage position within the document holder.

FIGS. 5 and 6 illustrate the manner in which a rolled document 30 is inserted into, stored in, and removed from the document holder 10 in accordance with the present invention. Referring first to FIG. 5, the rolled document 30, in preparation for its insertion into the document holder 10, is first wound to a tightness corresponding to a diameter sufficiently less than its storage diameter so as to permit its passage through the slot 18 of the document holder 10. A medial length of the rolled document 30 is then inserted through the slot 18 into the hollow interior portion 16 of the document holder 10. Once the inserted medial length is positioned within the interior portion 16, the rolled document 30 is released and allowed to untighten to its storage diameter corresponding to the diameter of the interior portion 16. When at its storage diameter, the rolled document 30 will not readily pass back through the slot 18, and will be retained in its rolled configuration within the document holder 10, as shown in FIG. 6. Furthermore, due to the pressure exerted by the rolled document 30 against the wall portion 14 of the document holder 10, the rolled document 30 may be stored in a vertical position without the document holder 10 sliding off. Facile removal of the rolled document 30 from the document holder 10 is achieved by reverting to the FIG. 5 position with the rolled document 30 being retightened to a diameter sufficiently less than its storage diameter so as to permit its passage from the interior portion 16 back through the slot 18.

The document holder in accordance with the present invention thus permits facile insertion and removal of rolled documents thereinto and therefrom without damage to the document, and provides a relatively inexpensive and compact means for effectively retaining various types of rolled documents, such as blueprints, drawings, paintings, maps, posters, certificates, photographs and the like, in rolled configuration of predetermined and uniform diameter convenient for storage purposes, while also facilitating labeling of the documents in rolled condition for ready filing and retrieval from storage.

Having thus described the invention, what is desired to be protected by Letters Patent is presented by the following appended claims.

What is claimed is:

1. An assembly comprising a document holder and a rolled document retained by said document holder in a rolled configuration of predetermined diameter convenient for storage, said document holder comprising an open-ended sleeve of relatively rigid material and having a wall portion defining a hollow interior portion whose dimensions correspond to said predetermined diameter, said wall portion being provided with a continuous longitudinal slot extending therethrough along the entire length of said sleeve and opening into said interior portion of said sleeve, said rolled document having a medial length thereof retained within said interior portion of said sleeve, said slot being sufficiently narrow so as to retain said medial length of rolled document within said interior portion of said sleeve when said document is wound to a tightness corresponding to said predetermined diameter, said slot being sufficiently wide so as to permit passage of said medial length of rolled document therethrough into and out of said interior portion of said sleeve when said document is wound to a tightness corresponding to a diameter sufficiently less than said predetermined diameter.

2. The assembly of claim 1, wherein the exterior of said sleeve is provided with a substantially flat labeling surface for labeling said rolled document.

3. The assembly of claim 2, wherein said labeling surface extends longitudinally along the entire length of said sleeve, and is positioned diametrically opposite from said slot.

4. The assembly of claim 2, wherein said wall portion comprises two generally cylindrical sections joined together by a flattened intermediate section, said flattened intermediate section forming said labeling surface.

5. The assembly of claim 4, wherein said flattened intermediate section of said wall portion projects radially outwardly beyond the cylinder circumscribed by its adjoining cylindrical sections.

6. The assembly of claim 4, wherein said flattened intermediate section of said wall portion truncates the cylinder circumscribed by its adjoining cylindrical sections.

7. The assembly of claim 4, wherein said flattened intermediate section of said wall portion is positioned diametrically opposite from said slot.

8. The assembly of claim 1, wherein said slot is of a width providing a radial aperture through said wall portion within the range of from about 45 to less than 90 degrees.

9. The assembly of claim 1, wherein the outer surface of said wall portion is provided with a plurality of grip-enhancing ribs.

10. The assembly of claim 9, wherein said ribs extend longitudinally along the entire length of said sleeve.

11. The assembly of claim 2, wherein said labeling surface is provided with means for having a label removably inserted and retained thereon.

12. The assembly of claim 11, wherein said label retaining means comprises a pair of parallel complimentary bracketing members extending longitudinally along the length of said labeling surface and projecting radially outwardly therefrom.

13. A method for retaining a rolled document in a rolled configuration of predetermined diameter convenient for storage, comprising the steps of:

providing a document holder comprising an open-ended sleeve of relatively rigid material and having a wall portion defining a hollow interior portion whose dimensions correspond to said predetermined diameter, said wall portion being provided with a continuous longitudinal slot extending therethrough along the entire length of said sleeve and opening into said interior portion of said sleeve;

winding said rolled document to a tightness corresponding to a diameter sufficiently less than said predetermined diameter so as to permit passage of a medial length of said rolled document through said slot into said interior portion of said sleeve;

inserting said medial length of said rolled document through said slot into said interior portion of said śleeve; and releasing said rolled document so as to allow it to untighten to the dimensions of said interior portion of said sleeve corresponding to said predetermined diameter.

14. The method of claim 13, wherein the exterior of said sleeve is provided with a substantially flat labeling surface for labeling said rolled document.

15. The method of claim 14, wherein said labeling surface extends longitudinally along the entire length of said sleeve, and is positioned diametrically opposite from said slot.

16. The method of claim 13, wherein said slot is of a width providing a radial aperture through said wall portion within the range of from about 45 to less than 90 degrees.

* * * * *